US011060037B2

(12) United States Patent
Chambron et al.

(10) Patent No.: US 11,060,037 B2
(45) **Date of Patent: *Jul. 13, 2021**

(54) METHOD FOR PURIFYING A GAS RICH IN HYDROCARBONS

(71) Applicant: L'Air Liquide, Société Anonyme pour l'Etude et l'Exploitation des Procédés Georges Claude, Paris (FR)

(72) Inventors: Nicolas Chambron, Saint Maur des Fosses (FR); Pierre Costa De Beauregard, Issy les Moulineaux (FR); Henri Paradowski, Pluvigner (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 359 days.

This patent is subject to a terminal disclaimer.

(21) Appl. No.: 15/746,456

(22) PCT Filed: Jul. 12, 2016

(86) PCT No.: PCT/FR2016/051789

§ 371 (c)(1),
(2) Date: Jan. 22, 2018

(87) PCT Pub. No.: WO2017/013329

PCT Pub. Date: Jan. 26, 2017

(65) Prior Publication Data

US 2018/0208855 A1 Jul. 26, 2018

(30) Foreign Application Priority Data

Jul. 23, 2015 (FR) ..... 1557018

(51) Int. Cl.
*C10G 5/06* (2006.01)
*F25J 1/00* (2006.01)
(Continued)

(52) U.S. Cl.
CPC ..... *C10G 5/06* (2013.01); *C10G 70/043* (2013.01); *C10L 3/101* (2013.01); *F25J 1/0022* (2013.01);
(Continued)

(58) Field of Classification Search
CPC ..... F25J 1/0022; F25J 3/0209; F25J 3/0214
See application file for complete search history.

(56) References Cited

U.S. PATENT DOCUMENTS 3,702,063 A 11/1972 Etzbach et al.
3,970,441 A * 7/1976 Etzbach ..... F25J 1/0214 62/612
(Continued)

FOREIGN PATENT DOCUMENTS

CA 2448884 A1 * 12/2002 ..... F25J 1/0239
EP 0094010 A2 * 11/1983 ..... F25J 1/0215
(Continued)

OTHER PUBLICATIONS

Chiu, C.-H., "LPG-recovery processes for baseload LNG plants examined," Oil & Gas Journal, Nov. 24, 1997, 59-63.
(Continued)

*Primary Examiner* — Len Tran
*Assistant Examiner* — Jenna M Hopkins
(74) *Attorney, Agent, or Firm* — Elwood L. Haynes

(57) ABSTRACT

A process for the purification of a gas rich in hydrocarbons and comprising at least 10 ppm by volume of hydrocarbons having at least six carbon atoms nitrogen.

7 Claims, 1 Drawing Sheet

(51) Int. Cl.

| | |
|---|---|
| ***F25J 1/02*** | (2006.01) |
| ***F25J 3/02*** | (2006.01) |
| ***C10G 70/04*** | (2006.01) |
| ***C10L 3/10*** | (2006.01) |

(52) U.S. Cl.

CPC ..... *F25J 1/0047* (2013.01); *F25J 1/0055* (2013.01); *F25J 1/0212* (2013.01); *F25J 1/0238* (2013.01); *F25J 3/0209* (2013.01); *F25J 3/0214* (2013.01); *F25J 3/0233* (2013.01); *F25J 3/0247* (2013.01); *F25J 2200/02* (2013.01); *F25J 2200/74* (2013.01); *F25J 2215/04* (2013.01); *F25J 2220/60* (2013.01); *F25J 2245/02* (2013.01); *F25J 2270/18* (2013.01); *F25J 2270/66* (2013.01); *F25J 2290/12* (2013.01)

(56) References Cited

U.S. PATENT DOCUMENTS 4,188,282 A * 2/1980 Tabak ..... B01J 29/44 208/134
4,352,685 A * 10/1982 Swallow ..... C07C 7/04 62/630
4,428,759 A * 1/1984 Ryan ..... F25J 3/0219 62/635
4,445,916 A * 5/1984 Newton ..... F25J 1/0022 62/621
4,445,917 A * 5/1984 Chiu ..... F25J 1/0215 62/625
4,460,395 A * 7/1984 Nobles ..... F25J 3/0266 423/437.1
4,563,202 A * 1/1986 Yao ..... F25J 3/0209 2/17
4,584,424 A * 4/1986 Barthomeuf ..... C07C 7/13 585/828
4,697,039 A * 9/1987 Schmidt ..... C07C 15/08 585/475
4,707,170 A * 11/1987 Ayres ..... C07C 7/005 62/622
RE32,600 E * 2/1988 Ryan ..... B01D 3/146 62/635
4,783,568 A * 11/1988 Schmidt ..... C07C 15/08 585/475
5,659,109 A * 8/1997 Fernandez de la Vega ..... C10L 3/10 585/834
5,737,940 A * 4/1998 Yao ..... F25J 1/0022 62/620
6,368,385 B1 * 4/2002 Paradowski ..... B01D 53/1487 95/181
6,449,982 B1 * 9/2002 Fischer ..... F25J 1/0237 62/613
6,449,984 B1 * 9/2002 Paradowski ..... F25J 1/0022 62/613
6,662,589 B1 * 12/2003 Roberts ..... F25J 1/0241 62/425
9,803,917 B2 * 10/2017 Burmberger ..... F25J 1/0022
10,077,937 B2 * 9/2018 Millar ..... F25J 1/02
10,415,879 B2 * 9/2019 Costa De Beauregard ..... F25J 3/08
2004/0079107 A1 * 4/2004 Wilkinson ..... F25J 1/0239 62/611
2004/0255616 A1 * 12/2004 Maunder ..... F25J 1/004 62/611
2005/0247078 A1 * 11/2005 Wilkinson ..... F25J 1/0205 62/612
2007/0012072 A1 * 1/2007 Qualls ..... F25J 1/0022 62/613
2007/0056318 A1 * 3/2007 Ransbarger ..... F25J 1/0022 62/611
2007/0157663 A1 * 7/2007 Mak ..... F25J 1/0022 62/620
2010/0024476 A1 * 2/2010 Shah ..... B01D 53/62 62/617
2010/0058803 A1 * 3/2010 Ransbarger ..... F25J 1/0022 62/612
2010/0217056 A1 * 8/2010 Taylor ..... C07C 2/66 585/323
2011/0126451 A1 * 6/2011 Pan ..... F25J 1/0022 44/451
2011/0174016 A1 * 7/2011 Carnell ..... C10L 3/08 62/611
2011/0265511 A1 11/2011 Fischer et al.
2011/0277500 A1 * 11/2011 Bauer ..... F25J 3/0233 62/630
2012/0017639 A1 * 1/2012 Peterson ..... C10L 3/02 62/611
2012/0090355 A1 * 4/2012 Johnson ..... F25J 3/0209 62/618
2013/0061632 A1 * 3/2013 Brostow ..... F25J 1/0022 62/611
2013/0213088 A1 * 8/2013 Stylianou ..... C10L 3/101 62/630
2014/0182331 A1 * 7/2014 Burmberger ..... F25J 1/0022 62/630
2014/0238076 A1 * 8/2014 Qualls ..... F25J 1/0022 62/630
2014/0260417 A1 * 9/2014 Herzog ..... F25J 1/0022 62/611
2015/0013379 A1 * 1/2015 Oelfke ..... F25J 1/0022 62/612
2015/0308737 A1 * 10/2015 Chen ..... F25J 3/061 62/623
2015/0316316 A1 * 11/2015 Oelfke ..... F25J 1/0292 62/611
2015/0362250 A1 * 12/2015 Wang ..... F25J 3/0209 62/611
2015/0369534 A1 * 12/2015 Wang ..... F25J 1/0022 62/613
2016/0061516 A1 * 3/2016 Seitter ..... F25J 1/0022 62/612
2016/0061517 A1 * 3/2016 Seitter ..... F25J 1/0042 62/612
2016/0061518 A1 * 3/2016 Seitter ..... F25J 1/0052 62/613
2016/0109178 A1 * 4/2016 Lee ..... F25J 1/0022 62/614
2016/0207853 A1 * 7/2016 Holden ..... C07C 7/08
2016/0216030 A1 * 7/2016 Truong ..... F25J 3/0214
2016/0313056 A1 * 10/2016 Kikkawa ..... F25J 1/0262
2016/0327335 A1 * 11/2016 Brostow ..... F25J 1/0022
2017/0028312 A1 * 2/2017 Becker ..... C07C 7/05
2017/0121256 A1 * 5/2017 Kim ..... B01D 3/4211
2017/0247303 A1 * 8/2017 Thirasak ..... C07C 7/08
2017/0328631 A1 * 11/2017 Kobayashi ..... F25J 1/0022
2018/0023889 A1 * 1/2018 Chen ..... F25J 1/0022 62/614
2018/0066889 A1 * 3/2018 Gaskin ..... F25J 3/08
2018/0073803 A1 * 3/2018 Schwint ..... F25J 3/0242
2018/0149424 A1 * 5/2018 Oelfke ..... F25J 1/0292
2018/0259249 A1 * 9/2018 Repasky ..... F25J 1/023
2019/0218161 A1 * 7/2019 Simanzhenkov ..... B01D 5/003

FOREIGN PATENT DOCUMENTS

EP 0102087 A2 * 3/1984 ..... F25J 1/0022
FR 2884304 A1 * 10/2006 ..... B01D 53/002
FR 2 923 000 5/2009
OA 7599 A * 3/1985 ..... F25J 1/0022
WO WO 01 88447 11/2001
WO WO 2006 123240 11/2006
WO WO 2015 098124 7/2015

OTHER PUBLICATIONS

International Search Report for corresponding PCT/FR2016/051789, dated Oct. 28, 2016.

(56) References Cited

OTHER PUBLICATIONS

Written Opinion for corresponding PCT/FR2016/051789, dated Oct. 28, 2016.
Matar, S. and Hatch, L.F., editors, Chemistry of Petrochemical Processes, 2nd ed., 2000, Gulf Publishing Co., Houston, TX, pp. 7 and 50.

* cited by examiner

METHOD FOR PURIFYING A GAS RICH IN HYDROCARBONS

CROSS REFERENCE TO RELATED APPLICATIONS

This application is a 371 of International Application PCT/FR2016/051789, filed Jul. 12, 2016, which claims priority to French Patent Application 1557018, filed Jul. 23, 2015, the entire contents of which are incorporated herein by reference.

BACKGROUND

The present invention relates to a process for the purification of a gas rich in hydrocarbons, for example natural gas. Such a process is employed, for example, in units for the liquefaction of natural gas or in units for the purification of natural gas. Typically, natural gas comprises "heavy" hydrocarbons and aromatic derivatives. The term "heavy hydrocarbons" is understood to mean hydrocarbons having more than four carbon atoms, including in particular hydrocarbons having more than six carbon atoms. Aromatic derivatives are cyclic compounds, such as benzene, xylene or toluene, for example.

In order to prevent the freezing of some heavy hydrocarbons and aromatic derivatives, such as benzene, for example during the liquefaction of natural gas, it is advisable to withdraw them at a temperature sufficiently high to prevent any risk of formation of solids.

One existing solution is to send "hot" natural gas (that is to say, before entry into a liquefaction exchanger) into a washing column, where it is washed and freed from its heavy constituents, including benzene. The gas stream at the top outlet of this column, purified from heavy compounds, is subsequently sent to a liquefaction exchanger, where it condenses. An intermediate outlet in the exchanger makes it possible to recover a liquid flow resulting from the partial condensation of the natural gas, and is used to produce the column top reflux.

The disadvantage of this solution is that the washing of a column at ambient temperature with a cryogenic liquid, furthermore at thermodynamic equilibrium as typically resulting from a partial condensation pot, results in a very high instantaneous vaporization which reflects poor thermal integration of the system and thus a low effectiveness.

Furthermore, the composition and the operating conditions of the natural gas to be treated can change over the lifetime of the unit and the liquid column top reflux may not be sufficient if it depends only on a partial condensation.

SUMMARY

The invention intends to solve the problems described above related to the abatement of the heavy hydrocarbons and of the aromatic derivatives, in particular benzene, present in natural gas.

A subject-matter of the present invention is a process for the purification of a gas rich in hydrocarbons and comprising at least 10 ppm by volume of hydrocarbons having at least six carbon atoms (such as benzene), comprising the following stages:

Stage a) Cooling the said gas to a temperature of between −20° C. and −60° C. by heat exchange with at least one coolant in a heat exchanger;

Stage b) Purification from compounds containing at least six carbon atoms of the gas partially liquefied in stage a) in a washing column containing a column top in its highest end and a column vessel in its lowest end, in order to form, at the washing column top, a gas stream containing less than 5 ppm by volume of compounds containing at least six carbon atoms and, at the washing column vessel, a liquid stream enriched in compounds containing at least five carbon atoms;

Stage c) At least partial condensation of the said gas stream resulting from stage b) in a heat exchanger, in order to form a two-phase stream;

Stage d) Separation of the said two-phase stream resulting from stage c) in a phase-separating pot at a temperature of between −60° C. and −80° C., in order to form a gas stream at the pot top and a liquid stream at the pot vessel;

Stage e) Use of the liquid stream resulting from stage d) as washing column top reflux;

Stage f) Condensation of the gas stream resulting from stage d) by heat exchange in a heat exchanger at a temperature of less than −100° C., in order to form a liquefied gas containing less than 5 ppm by volume of compounds containing at least six carbon atoms.

According to other specific forms, the present invention also has as subject-matter:

- A process as defined above, characterized in that the gas stream resulting from stage b) and the liquefied gas resulting from stage f) contain less than 1 ppm by volume of compounds containing at least six carbon atoms.
- A process as defined above, characterized in that the gas rich in hydrocarbons is natural gas.
- A process as defined above, characterized in that the said hydrocarbons having at least six carbon atoms comprise a predominance of benzene.
- A process as defined above, characterized in that the said coolant is a mixed coolant comprising nitrogen, methane, ethane and butane.
- A process as defined above, characterized in that at least a portion of the liquid stream formed during stage f) is tapped at a temperature of less than −100° C. and then recycled in the phase-separating pot employed in stage d).
- A process as defined above, characterized in that the liquid stream formed at the vessel of the phase-separating pot in stage d) is pumped using at least one pump in order to feed the top of the washing column employed in stage b).
- A process as defined above, characterized in that the operating temperature of stage a) is between −20° C. and −40° C.
- A process as defined above, characterized in that the operating temperature of stage d) is between −70° C. and −80° C.
- A process as defined above, characterized in that the operating temperature of stage f) is between −100° C. and −160° C.

The process which is a subject-matter of the present invention makes it possible to withdraw the heavy constituents and aromatic derivatives, in particular benzene, from natural gas to be liquefied and is based on one or more washing stages at different temperature levels.

During the process which is a subject-matter of the present invention, cooling of the natural gas down to a first temperature level is first of all carried out, ensuring that the heavy constituents, in particular the benzene, present in the liquid generated do not freeze. The temperature is typically between −20° C. and −40° C.

The partially liquefied natural gas is subsequently sent into a washing column which makes it possible to produce, at the column top, a gaseous stream of natural gas purified from the heaviest compounds, observing in particular the specification desired with regard to benzene, and to produce, at the column bottom, a liquid stream enriched in heavy compounds, for example the products predominantly containing more than four carbon atoms and the various aromatic derivatives, in particular benzene.

The top gas, thus purified, is subsequently sent into the main exchange line, where it will again condense.

It is subsequently drawn off at a lower temperature level than the preceding one, chosen in order to make it possible to have a stream which is sufficiently two-phase to generate an amount of liquid consistent with the washing requirement of the column top.

Typically, the said temperature is between −60° C. and −80° C., preferably between −70° C. and −75° C.

The liquid is separated from the gas by means of a phase-separating pot and is sent as washing column top reflux. This time, the flash (i.e., the instantaneous vapour) is limited as the temperature levels between the column and the reflux liquid are closer. Depending on the installation of the pot with respect to the column, a pair of lift pumps may be envisaged.

Furthermore, the particularly low temperature of this phase-separating pot makes it possible to ensure good separation of the benzene from the gas, in the event of failure of the washing column, and thus offers additional protection.

BRIEF DESCRIPTION OF THE DRAWING

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
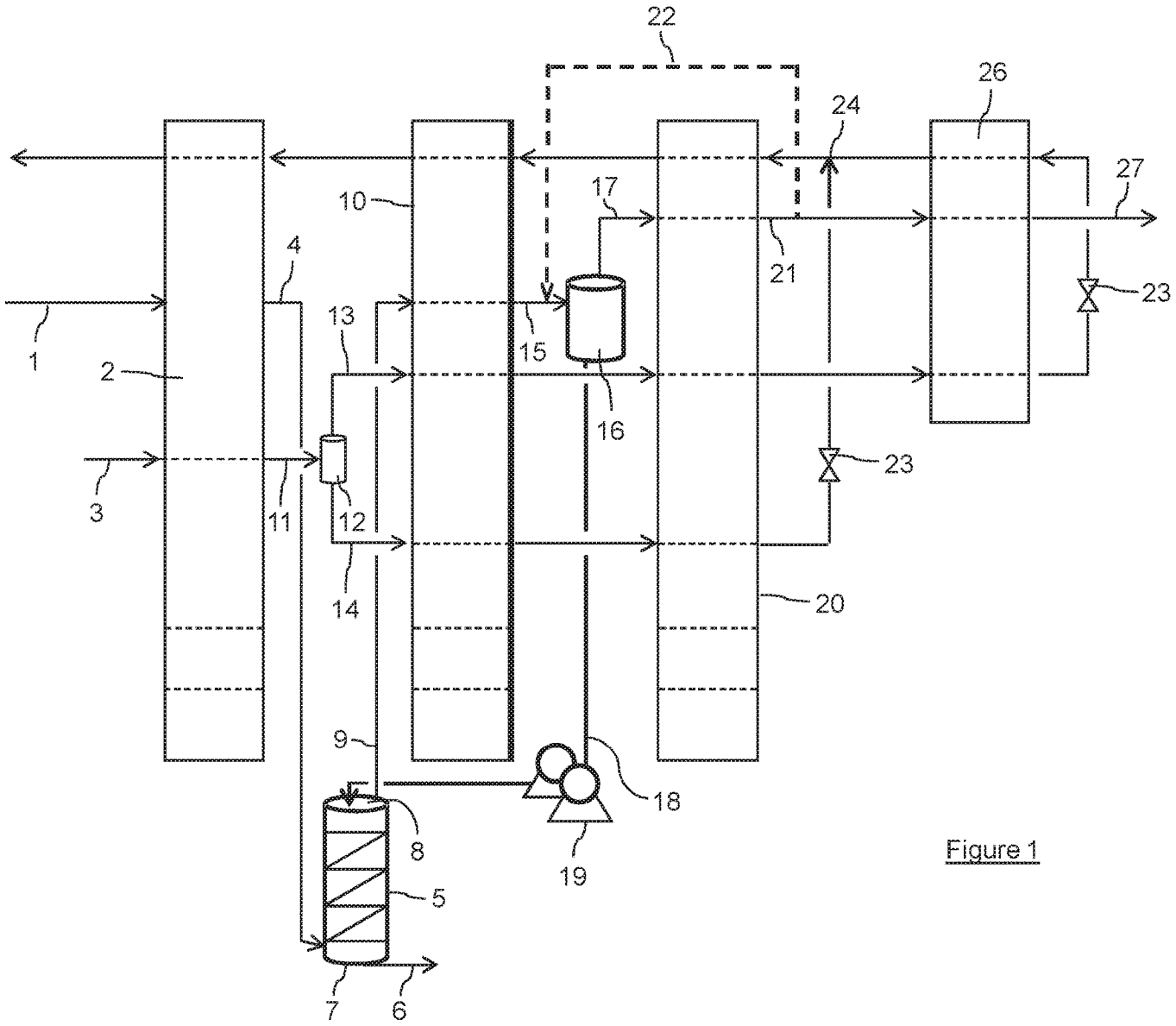
FIG. 1 is a schematic representation of one embodiment of the present invention.

The process which is a subject-matter of the present invention is illustrated in FIG. 1.

In FIG. 1, a gas stream 1 rich in hydrocarbons, such as a stream of natural gas, is introduced into a heat exchanger 2.

The pressure of this gas stream is, for example, between 25 and 60 bar abs. Typically, the gas stream 1 contains between 30 ppm by volume and 500 ppm by volume of benzene, usually less than 100 ppm by volume. The gas stream 1 is cooled by heat exchange in the heat exchanger 2 on contact with a coolant. The heat exchanger is fed with at least one coolant stream. For example, this stream can be composed of a mixed coolant stream. The composition and the operating conditions of the mixed coolant are adjusted to the hydrocarbon to be liquefied.

The stream of natural gas cooled to a temperature of between −20° C. and −70° C., typically of between −35° C. and −40° C., at the outlet 4 of the exchanger 2 is introduced into a washing column in which the heavy products are separated from the natural gas. The term "heavy products" is understood to mean the hydrocarbons having more than four carbon atoms and the aromatic compounds, including in particular benzene.

A liquid stream 6 containing all (to within about one ppm by volume) the benzene from the initial gas stream 1 is discharged at the vessel 7 of the column 5.

At the top 8 of the column 5, a gas stream 9 comprising less than 1 ppm by volume of benzene is recovered in order to be introduced into a second heat exchanger 10 which can preferably be a second section of the heat exchanger 2.

The mixed coolant stream 11 recovered at the outlet of the heat exchanger 2 is introduced into a phase-separating pot 12, producing a gas stream 13 containing the light components of the coolant at the pot 12 top and a liquid stream 14 containing the heavy components of the coolant at the pot 12 vessel. These two streams 13 and 14 feed the second heat exchanger 10 (or second stage of the exchanger 2).

The gas stream 9 containing less than 1 ppm by volume of benzene introduced into the second heat exchanger 10 (or second section of the exchanger 2) is at least partially condensed. The two-phase stream 15 at the outlet of the second heat exchanger 10 (or second section of the exchanger 2) is introduced into a phase-separating pot 16 in order to produce a gas stream 17 at the pot 16 top and a liquid stream 18 at the pot 16 vessel. The temperature is then typically between −70° C. and −75° C.

The liquid stream 18 feeds the top 8 of the washing column 5. Depending on the installation of the pot 16 with respect to the column 5, a pair 19 of lift pumps may be present in order to suck the liquid stream 18 in order to carry out the column 5 top 8 reflux.

It should be noted that the liquid reflux (stream 18) may not be sufficient and that, in this case, it is possible to cool the pot 16 by injecting liquid natural gas at the inlet of the two-phase pot (line 22). This line 22 is important as it makes it possible to control the flow of liquid reflux into the column 5 and thus the benzene content of the product to be liquefied. As the composition and the operating conditions of the natural gas can change during the lifetime of the unit, the reflux flow necessary can thus be optimized, and also the liquefaction energy.

There exist at least two alternative forms for this solution, which is a subject-matter of the present invention:

- Alternative form No. 1: In order to simplify the main exchanger, it is possible to directly "shower" the column 5 top with liquid natural gas (stream 22) but the flow of liquid natural gas 22 is then greater and this option can be costly in liquefaction energy.
- Alternative form No. 2: In order to reduce the flow of liquid natural gas necessary, it is also possible to shower the top of the separating pot 16 and thus to purify the natural gas by two successive refluxes.

The gas stream 17 is introduced into a third heat exchanger 20, which can preferably be a third section of the exchanger 2, in order to be cooled to a temperature of less than −110° C., for example between −110° C. and −115° C. The stream 21 thus cooled can be partially tapped and form a stream 22 which will be recycled by being introduced with the stream 15 into the phase-separating pot 16.

This is because, according to a specific form of the process for the liquefaction of natural gas 1 which is a subject-matter of the invention, the liquid coolants 14 are drawn off and then subsequently reduced in pressure, for example using valves 23, before being reintroduced and revaporized in the exchange line 24 opposite the natural gas 17, which gas liquefies. Thus, a stream of liquid natural gas can be tapped 22 at this level (cooler than the phase-separating pot 16 forming the reflux of the column 5) and recycled in the pot 16 in order to increase the reflux liquid 18 in the event of lack of the latter, while limiting the loss in effectiveness by instantaneous vaporization.

Finally, the gas stream 21 is introduced into a heat exchanger 26 in order to produce a stream of liquefied natural gas 27, a product purified from heavy compounds and from aromatics, including typically benzene, resulting from the liquefaction and purification process which is a subject-matter of the present invention.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A process for the purification of a gas comprising hydrocarbons and comprising at least 10 ppm by volume of hydrocarbons having at least six carbon atoms, the process comprising the following stages:

Stage a) cooling the gas to a temperature of between −20° C. and −60° C. by heat exchange with at least one coolant in a heat exchanger;

Stage b) purifying from compounds containing at least six carbon atoms of the gas partially liquefied in stage a) in a washing column containing a column top at a highest end and a column vessel at the lowest end, thus forming at the column top, a gas stream containing less than 5 ppm by volume of compounds containing at least six carbon atoms and, at the column vessel, a liquid stream enriched in compounds containing at least six carbon atoms;

Stage c) condensing the gas stream resulting from stage b) in a heat exchanger, thus forming a two-phase stream;

Stage d) separating the two-phase stream resulting from stage c) in a phase-separating pot at a temperature of between −60° C. and −80° C., thus forming a gas stream at the pot top and a liquid stream at the pot vessel;

Stage e) introducing the liquid stream resulting from stage d) into the washing column as washing column top reflux;

Stage f) condensing the gas stream resulting from stage d) by heat exchange in a heat exchanger at a temperature of less than −100° C., thus forming a liquefied gas containing less than 5 ppm by volume of compounds containing at least six carbon atoms.

2. The process of claim 1, wherein the gas rich in hydrocarbons is natural gas.

3. The process of claim 1, wherein the hydrocarbons having at least six carbon atoms comprise a predominance of benzene.

4. The process of claim 1, wherein the coolant is a mixed coolant comprising nitrogen, methane, ethane and butane.

5. The process of claim 1, wherein at least a portion of the liquid stream formed during stage f) is tapped at a temperature of less than −100° C. and then recycled in the phase-separating pot employed in stage d).

6. The process of claim 1, wherein the liquid stream formed at the vessel of the phase-separating pot in stage d) is pumped using at least one pump in order to feed the top of the washing column employed in stage b).

7. The process of claim 1, wherein the at least one coolant is used to cool the gas in stage a) and to condense the gas in stage f).

* * * * *